United States Patent [19]

Bishop

[11] 4,147,078

[45] Apr. 3, 1979

[54] TREATMENT OF WEB MATERIAL

[75] Inventor: Thomas D. Bishop, Birmingham, England

[73] Assignee: The Deritend Engineering Company Limited, Birmingham, England

[21] Appl. No.: 858,748

[22] Filed: Dec. 8, 1977

[30] Foreign Application Priority Data

Dec. 14, 1976 [GB] United Kingdom ..... 52447/76

[51] Int. Cl.[2] ..... B26H 17/08

[52] U.S. Cl. ..... 83/74; 83/313; 226/30; 226/143

[58] Field of Search ..... 83/74, 75, 312, 313; 226/143, 29, 30

[56] References Cited

U.S. PATENT DOCUMENTS

| | | | |
|---|---|---|---|
| 3,283,629 | 11/1966 | Huck | 83/75 |
| 3,739,968 | 6/1973 | Bodendoerfer | 83/74 X |
| 3,756,149 | 9/1973 | Bishop | 226/143 X |

*Primary Examiner*—J. M. Meister

*Attorney, Agent, or Firm*—Marshall & Yeasting

[57] ABSTRACT

Apparatus for die-cutting preprinted web has an adjustable web feed mechanism which is controlled by circuitry for detecting mis-registration between die-cutting and the preprinted portions of the web, of which the following is a specification.

10 Claims, 3 Drawing Figures

TREATMENT OF WEB MATERIAL

This invention relates to the production of treated discrete blanks from a prepared web of material — for example, in the production of printed and die cut blanks, where the printed and die cut areas require to be synchronised, and the invention is concerned with the stage in such process where the preprinted web is to be due cut.

It has been previously suggested that signals can be taken from a preprinted web and used to adjust a gearbox transmitting drive to a roll carrying a simple cutting knife with the object of bringing the knife into synchronism with the desired point for cutting the web. This can correct for original maladjustment or lack of synchronism. It has also been suggested that the gearbox can then be reset to the predetermined value so that in theory all subsequent cuts will be in register. The proposal recognised that a number of factors may contribute towards drift from synchronism and suggested periodic adjustments to restore and maintain synchronism. However, these proposals rely upon varying the speed of the knife-carrying roll between successive cuts, this being possible because there is somewhere near 360° of movement of the knifecarrying roll for adjustment between successive cuts.

The problem is quite different where the web is to be die cut, that is to say a pattern of cuts and possibly also creases is to be applied to the web over a substantial length of the same by the cutting cylinder. For this purpose, the cutting cylinder must have a peripheral speed which is the same as that of the web, and the time availble for adjusting the angular position of the roll and for restoring it to the same speed as that of the web is only equal to the time interval between two successive die cutting operations from the same roll, and at normal production speeds such adjustment is impossible.

A further complication in such process results from the use of rotary die cutting apparatus which bear a cutting forme on one roll of a roll pair, where the length of the cutting forme is less than the dimension of the periphery of the roll — which is usually the case since any one set of apparatus is likely to be required to be used to produce lengths of different final dimensions. If the cylinder were to run continuously so that its peripheral speed is the same as that of the web this would necessitate the production of blanks alternating with scrap portions or at least unused portions which would be of a length corresponding to the unoccupied portion of the periphery of the forme-cylinder, i.e. unnecessary spacing of the preprinted areas along the web, quite apart from the difficulty of attempting to adjust the roll position for the purpose of securing synchronism.

One solution for avoiding or minimising scrap is disclosed in our prior U.S. Pat. No. 3,756,149 wherein a feeder for use with web material is arranged so as to drive the web backwards and forwards, so that the forward movement registers a required point on the web with the commencement of operation of a die-cutting roll pair, and after the die-cutting operation has been completed, and whilst the die-cutting roll is making a relatively idle portion of its rotational travel, the web is reversed, brought to rest and then accelerated forwardly until its speed is again matched with the roll carrying the die-cutting forme. In this way, the web can be repositioned and synchronised with the commencement of the next die-cutting cycle so that wastage between successive blanks is considerably less than the gap between the leading and trailing edges of the forme. This enables the web to be pretreated, for example preprinted, without allowing for any more than minimal scrap portions between successive blanks to be produced, but per se relies upon accurate and precise operation of both the printer and the feeder, which calls for impossibly high orders of accuracy unless the tolerances are large.

A variant of the apparatus described in prior U.S. Pat. No. 3,756,149 is described in our co-pending patent application Ser. No. 800,317 in which, instead of providing a single pair of feed rollers causing both forward and reverse operation, feed takes place under the control of two sets of feed rollers, allowing a greater and finer degree of control.

It is found in practice that although the length of the blank is known and the preprinting or like treatment can theoretically be at fixed and predetermined spacings, some sort of continuous adjustment is still necessary for complete synchronisation, due to such matters as shrinkage or stretching of the web, irregularities in the running of the preprinting apparatus or the like. The object of the present invention is to provide an improved control system for ensuring synchronisation between a pretreated web and web treatment apparatus for subjecting the pretreated web to a subsequent treatment such as die-cutting.

According to one aspect of the invention we provide apparatus for treating web material bearing a series of pre-treated areas, said apparatus comprising a pair of rotatably driven treatment rolls including one roll having a treatment area which extends over part of its circumference and is generally co-extensive with one or more of said pretreated areas, said treatment area, when in confronting relation with the other roll of the pair, providing a nip by means of which the web is driven forwardly while it is contacted by the treatment area, an adjustable feed mechanism located adjacent the entering side of the roll pair, said feed mechanism constituting means for decelerating the web upon cessation of contact between the web and said treatment area, moving the web in the reverse direction, and then accelerating it in the forward direction to synchronize the web speed with the linear speed of the treatment area whereby, for a certain adjustment of the feed mechanism setting, the web is advanced forwardly, during the time between cessation of contact and renewed contact with the treatment area, by a standard length increment which, in the absence of any mis-registration between said treatment area and the pretreated web areas, maintains registration therebetween, characterised by: means for determining the mis-registration if any, that occurs between said treatment area and said pre-treated web areas over one or more cycles of operation of the apparatus, and means responsive to the misregistration-determining means and operable to temporarily adjust the feed mechanism setting during a following cycle of operation such that the web length advanced by the feed mechanism is varied to compensate for the mis-registration present, the feed mechanism thereafter being restored to its original setting.

The invention allows registration of die-cutting and printing to be brought about and maintained, without attempting to vary the speed of the die-cutting roll or the speed of the web, whilst at the same time avoiding or minimising the production of scrap areas between successive blanks.

According to a preferred feature of the invention, second mis-registration determining means is provided for determining the misregistration per cycle and said adjustment means has a second mode of adjustment in which the feed mechanism setting is adjusted such that the web length advanced is varied to compensate for at least the misregistration shown to be present by said first mis-registration determining means and the feed mechanism is adjusted to a new setting corresponding to a new standard length increment which differs from the previous standard by an amount equal to the misregistration per cycle as determined by the second means.

The invention will now be described by way of example with reference to the accompanying drawings in which.

Figure 1:
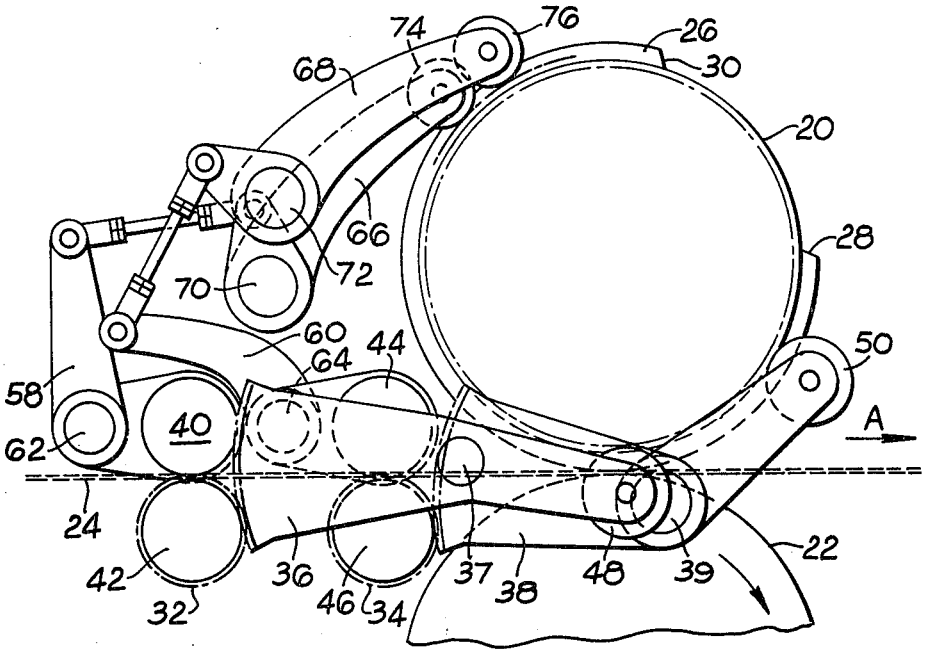
FIG. 1 is a diagrammatic side view of a pre-printed web die cutter apparatus.
Figure 2:
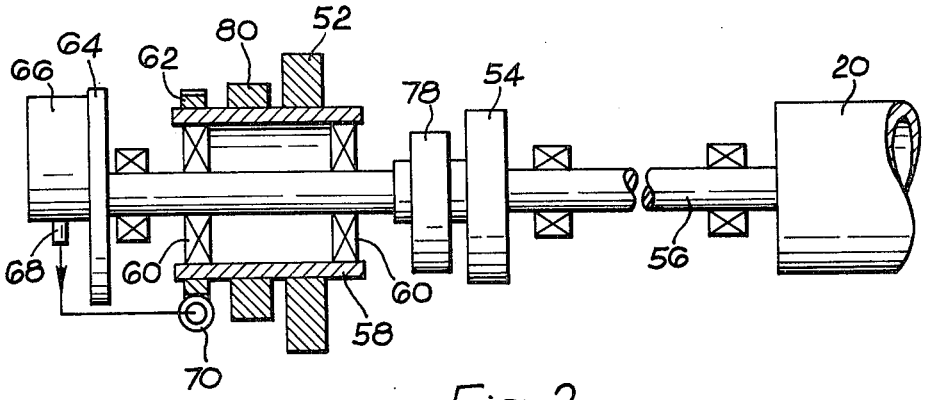
FIG. 2 is a diagrammatic end view of the apparatus showing, in particular, the arrangement of the cams for controlling the web feed rollers located on the entering side of the die cutter roll roll pair.

Referring firstly to FIGS. 1 and 2, the apparatus comprises an impression roll 20 and a complementary roll 22 which are rotated continuously at a constant speed and between which the web 24 is periodically driven in the direction A. The roll 20 carries a die cutting forme 26 which extends over the major part of its periphery, the leading and trailing edges of the forme being depicted by reference numerals 28 and 30 respectively. The forme 26 constitutes the treatment area of the roll 20 and when it is in confronting relation with the roll 22, it forms a nip by means of which the web is fed forwardly between the rolls 20 and 22 while being cut and creased by the forme 26. During the time that the gap between the trailing and leading edges is in confronting relation with the roll 22, feed of the web is under the control of a web feed mechanism located on the entering side of the roll pair 20, 22. This feed mechanism is described in detail in our co-pending patent application Ser. No. 800,317 to which reference should be made for further details.

Briefly, the feed mechanism is arranged to reposition the web in such a way that the wastage between adjacent die cut blanks is minimised whilst synchronising the web speed with linear speed of the forme at the points of transfer of web feed from the roll pair to the feed mechanism and vice versa. For this purpose, the feed mechanism comprises feed rolls 40, 42 and feed rolls 44, 46 each associated with pinions 32, 34 driven respectively by sector gears 36, 38 which, in turn, are turned angularly about pivots 37, 39 by co-operation of cam follower rollers 48, 50 with respective cams 54, 52 (see FIG. 2) which rotate with the drive shaft 56 for roll 20. The rollers 40, 44 are carried on respective double armed levers 58, 60 pivoted at 62, 64 which are turned angularly by respective cam followers 66, 68 which are pivoted at 70, 72 and have rollers 74, 76 which bear against respective cams 78, 80 (see FIG. 2), also rotatable with the drive shaft 56. There is a drive connection between each roller 42, 46 and the associated roller 40, 44 so that when the former are driven, the rollers 40, 44 rotate at the same speed, irrespective of whether they are raised or lowered.

The arrangement and shaping of the cams 52, 54, 78 and 80, is such that the following sequence of events occurs during each cycle. During die cutting, the sector gears 36, 38 are in the position shown in FIG. 1 and the rollers 40, 44 are raised out of contact with the web. Shortly prior to cessation of contact between the forme and the web (at which time the web is being advanced forwardly by the roll pair at a linear speed determined by the rotation speed of the roll pair), the cam 54 begins to turn the sector gear 36 to accelerate the rollers 40, 42 so that at the instant the trailing edge 30 of the forme 26 penetrates and severs the web, the linear or peripheral speed of rollers 40, 42 is the same as that of the roll pair 20, 22 and hence the web. At this instant, cam 78 displaces roller 40 downwardly so that forward drive is now imparted to the web by rollers 40, 42. Thereafter the profile of cam 54 causes the roller 40, 42 to decelerate the web (while still travelling forwardly) and bring it to a halt.

At this point, the upper end of the sector 36 is in mesh with the pinion 32 and the profile of the cam 54 is shaped so that continued clockwise rotation of shaft 56 returns the sector 36 to the FIG. 1 position thus rotating rollers 40, 42 in the reverse direction and because the roller 40 is still lowered, feeding the web in the reverse direction and bringing it to rest. The profile of cam 54 is such that the sector 36 remains in the FIG. 1 position until the procedure is repeated in the following cycle. As the leading edge 28 of the forme approaches the nip position, the roller 44 is lowered by the cam 80 and then the cam 78 raises roller 40. The rollers 44, 46 are then accelerated by cam 52 via sector 38 so that when the forme makes renewed contact with the web 24, the latter is travelling forwardly at the same linear speed as the forme 26. At this point, cam 80 raises the roller 44 to allow further feed of the web to be effected by the roll pair 20, 22. The sector 38 in the meantime completes its counterclockwise stroke and is returned to its FIG. 1 position but the accompanying rotation of the rollers 44, 46 has no influence on the web because the roller 44 is raised. It will be understood from the foregoing that by appropriate adjustment of the various cams, the web can be repositioned during the idle period of the roll pair 20, 22 so as to virtually eliminate wastage by arranging for the web edge cut by the trailing edge 30 of the forme to coincide with the leading edge 28 of the forme during the next cycle of operation.

FIG. 2 illustrates diagrammatically one form of cam adjustment mechanism employed in the present invention. As shown, the cams 54 and 78 associated with the rollers 40, 42 are fastened directly to the drive shaft 56 whereas the cams 52 and 80 associated with rollers 44, 46 are rotatably fast with a sleeve 58 which is mounted for rotation relative to the shaft 56 via bearings 60 and has a ring gear 62 secured thereto. Beyond the sleeve 58, the shaft 56 carries a frame 64 to which a reversible electric motor 66 is secured whose output shaft 68 drives a worm gear 70 via a suitable drive transmission, the worm gear 70 being rotatable about an axis perpendicular to the plane of the paper as seen in FIG. 2 and being in mesh with the ring gear 62. Thus, by energising the motor 66, the cams 52, 80 can be adjusted angularly with respect to cams 54, 78 and when the desired angular setting has been obtained, the sleeve 58 is held rotatably fast to the shaft 56 by the meshing engagement between worm 70 and gear 62, the motor 66 having an electromechanical brake to hold the sleeve 58 in a desired setting.

The web to be die cut will typically be preprinted and will comprise a series of longitudinally successive areas to be blanked by the die cutting operation. Each such area will ideally be of known length, for example 1,000mm and the forme is therefore designed to cut blanks of 1,000mm length from the web. Thus, in the ideal situation, once the preprinted web areas have been synchronised with the forme, the prints will be properly registered with all of the die cut blanks, i.e. the leading and trailing edge of the pre-printed web areas will coincide with the leading and trailing cut edges of the blans. In practice however, various factors such as web shrinkage or stretch, tension changes, etc., give rise to transient or more permanent changes in the length of the preprinted web area and consequently while the apparatus may be initially set up with exact registration, these factors can rapidly create significant mis-registration which, if not corrected, would render the blanks produced unusable. For example, if the web undergoes shrinkage such that the length of each pre-printed web area is 999.5mm, then in the absence of any corrective action, the web and die cutting forme will become increasingly out of register to the extent of 0.5mm per cycle because the die cutter will be cutting 1,000mm blanks.

Figure 3:
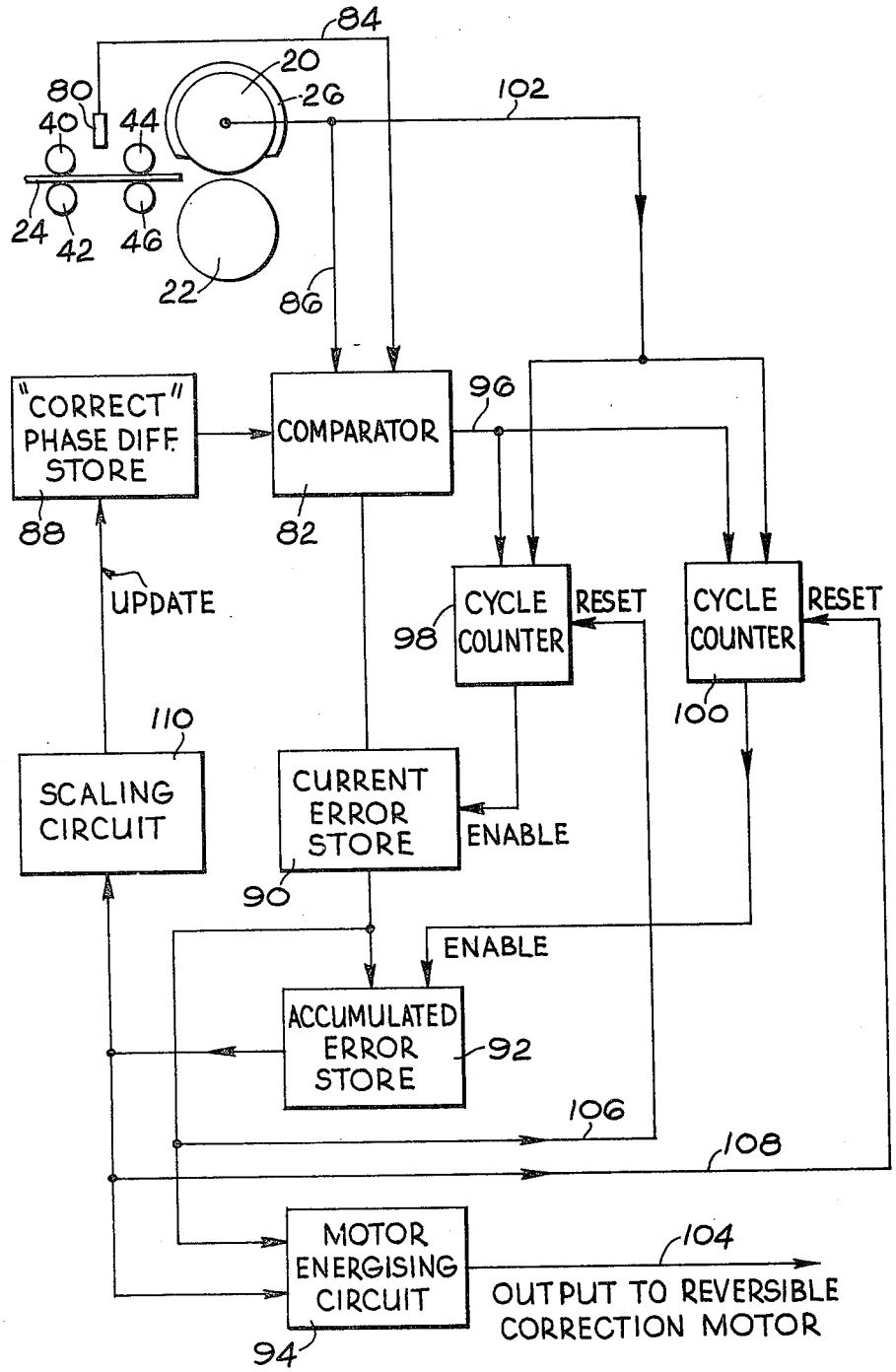
FIG. 3 is a block diagram of the circuitry employed in detecting mis-registration between the pre-printed areas of the web and the die cutting forme.

Referring now to FIG. 3, there is shown, in block diagrammatic form, circuitry for controlling the electric motor 66 in order to adjust the feed mechanism to compensate for mis-registration between the forme 26 and the pre-printed web areas. Each pre-printed web area to be blanked is conveniently provided with a mark, known in the art as a print register mark (PRM), which is located a predetermined distance from the trailing edge of the web area: for example, the PRM may be located 200mm from the trailing edge in a web area of length of 1,000mm. The location of the PRM on the leading web area relative to a given point, e.g. the trailing edge, on the forme 26 therefore provides a measure of the mis-registration between the web and forme. In the ideal situation where the web is not subject to any distortion and there is exact registration between web and forme, the trailing edge of the forme will penetrate and sever the web 200mm rearwardly of the PRM of the blank then being die cut.

Each PRM is sensed by a suitable sensor 80, e.g. a photo detector arrangement, as it approaches the roll pair 20, 22, the arrangement being such that the sensor 80 is only enabled during that part of the cycle of operation in which the web is travelling at the same linear speed as the roll pair. The electrical output of the sensor 80 is fed via line 84 to a comparator circuit 82 which also receives, via line 86, a signal from the roll pair 20, 22 which represents the angular position of the roll 20 relative to a reference position and from these signals, the comparator 82 derives a measure of the position of the approaching PRM relative to the trailing edge of the forme 26 (i.e. the actual phase difference) which it compares with the "correct" phase difference stored in store 88. In the example mentioned above, the stored phase difference will be 200mm. If the comparator 82 ascertains that the measured phase difference is equal to the stored phase difference or is within a certain tolerance range about "correct" phase difference, then there is no significant mis-registration present and corrective action is unnecessary. If however, the comparator 82 ascertains that the measured phase difference deviates significantly from the "correct" phase difference then the magnitude of the deviation is entered into a "current error" store 90 whose output is connected to an "accumulated error" store 92 and to a motor energising circuit 94. The comparator, in these circumstances, also provides an enabling signal on line 96 which enables counters 98, 100 to commence counting signals fed thereto via line 102, the latter signals representing the angular position of the roll 20 and the arrangement being such that the counters 98, 100 are incremented by one count each time the trailing edge of the forme 26 reaches predetermined point, e.g. the point at which it penetrates the web 24. Thus, when enabled, the counters 98, 100 count the number of cycles of operation. Conveniently, if the mis-registration exceeds a certain unacceptable level, the comparator 82 may be arranged to initiate shut down of the apparatus and/or actuate a visual and/or audible warning device to indicate the existance of an abnormal condition.

The counters 98, 100 control read-out of the stores 90, 92 respectively such that the contents thereof are only read out to the motor energising circuit 94 when each counter reaches a respective predetermined count n,N which, for counter 98, may be one or more and, for counter 100, can be one but preferably is two or more. The following description is given for the case where $n=2$ and $N=6$. During the first cycle that the comparator 82 detects deviation, the deviation is entered in store 90 and counters 98, 100 are enabled and register a count of one when the trailing edge of the forme penetrates the web to blank off the web area which gave rise to the mis-registration sensed. At this stage, the contents of the store 90 cannot be read out because counter 98 only contains a count of one. The feed mechanism therefore follows its normal operational cycle and repositions the web so that the leading edge thereof (which corresponds to the trailing edge of the web area previously blanked off) enters the nip between the roll air 20, 22 in register with the leading edge of the forme 26. The forme then die cuts another 1,000mm blank.

Suppose now that the deviation present is due to web shrinkage such that each preprinted web area is 999.5mm in length instead of 1,000mm, i.e. a deviation of 0.5mm. Thus, after completion of the first cycle, the store 90 will contain an error value equivalent to 0.5mm. During the second cycle, the comparator detects a deviation in phase difference equivalent to 1.0mm and updates the store 90 with this value. Upon completion of the second cycle, counters 98, 100 are advanced to a count of 2 and counter 98 provides an enabling signal to store 90 causing the latter to read-out its contents to the store 92 and to the motor energising circuit 94. The circuit 94 now provides a signal via line 104 to the motor 66 which is rotating with a roll 20, there being a slip ring or like electrical connection between the line 104 and the input terminals of the motor 66. This signal resets counter 98 to zero via line 106 and causes the motor 66 to adjust the sleeve 58 angularly to a position in which the timing of the cams 52, 80 creates a 1mm lag of the leading web edge relative to the leading forme edge so that a 999.0mm web length is cut during that cycle thus correcting for the 1.0mm mis-registration accumulated over the preceding two cycles. The circuit 94 is arranged to detect whether it receives either a single input from store 90 or two inputs from stores 90 and 92: in the former instance, the circuit 94 is operative to restore the motor 66 and hence the sleeve 58 to its previous setting and, in the latter instance, adjustment of the sleeve 58 is modified as explained hereinafter. Thus, after the adjustment just described, the sleeve 58 is restored to its previous angular setting in preparation for the next operational cycle of the feed mechanism which occurs following blanking off of the third web area.

During die cutting of the third web area, the comparator 82 again detects a 0.5mm deviation, enters this in the store 90 and enables counter 98. No further corrective action occurs until the fourth web area has been blanked off at which time the contents of store 90 (i.e. 1.0mm) is again read out to circuit 94 which adjusts the sleeve 58 via motor 66 so that a 1.0mm lag is introduced during transfer of the web from the feed mechanism to the roll pair 20,22. Immediately thereafter, the motor 66 is operated to restore the sleeve to its original setting. At the completion of the fourth cycle, the store 92 contains an accumulated deviation of 2.0mm but has not been read out to circuit 94 because counter 100 has not yet reached a count of 6. Upon completion of the sixth cycle, the store 90 contains a current error of 1.0mm, store 92 contains an accumulated error of 3.0mm and both stores are enabled by their respective counters 98, 100. Store 90 therefore reads out an error of 1.0mm to circuit 94; store 92 however incorporates a divider circuit by means of which the average error per cycle can be determined by dividing the accumulated error by the number of cycles over which it is accumulated. Thus, store 92 reads out a value of 0.5mm to the circuit 94. At the same time, the counters 98, 100 are reset to zero via lines 106 and 108.

Prior to operation of the rollers 44, 46, the motor 66 is energised by the circuit 94 so as to adjust the sleeve 58 to correct for mis-registration amounting to 1.0+0.5mm (as read out by stores 90 and 92) whereby a 1.5mm lag is introduced into the foward feed of the web by rollers 44, 46 thus correcting for the error present after completion of the sixth cycle and for the average error per cycle which is presumed to be present in the seventh cycle. Thereafter, the circuit 94 resets the sleeve 58 via motor 66 to a new setting in which the rollers 44, 46 lag the leading forme edge by 0.5mm thereby eliminating the 0.5mm registration in the phase difference between the PRM and the trailing edge of the forme 26. In subsequent cycles, the roll pair 20, 22 cut web lengths of 999.5mm to correspond with the reduced length of the preprinted web areas. If further changes in the web are detected, the above procedure is agin repeated.

For the purpose of initial setting up of the apparatus the circuit may include a MANUAL/AUTO switch which, when in the MANUAL setting, causes the rolls 20, 22 to run slowly and disables the store 92 and counter 100. Any mis-registration present due to operator error, i.e. the PRM and the trailing forme edge may be set up say 5mm out of registration, is then taken care of after the second cycle in that the third blank will be cut to a length of 995mm thereby bringing the PRM and the forme trailing edge into proper phase relation which will be maintained for subsequent cycles. Once the correct phase relation is obtained, the MANUAL-/AUTO switch can be changed to AUTO and the store 92 and counter 100 become operative and the machine runs at its normal speed.

The foregoing description is of an ideal situation. In practice, the variation in the length of the preprinted web area may fluctuate considerably over the space of a relatively small number of cycles, i.e. instead of a constant deviation of 0.5mm per web area, the length may vary by different amounts and short term attempts at ascertaining and correcting the deviation per cycle will not, in general, give an accurate result and may even tend to compound the error. With the arrangement provided by the preferred embodiment of the invention, the deviation per cycle can be ascertained over several cycles thus producing a more accurate result whilst avoiding such an accumulation of error that the blanks produced during the determination of the average deviation have to be scrapped, i.e. the mis-registration is kept within acceptable bounds by periodic corrections until sufficient information has been accumulated to enable an accurate correction to be made.

From the foregoing description, it will be seen that the effect of the corrections made is to locate the trailing cut edge of each blank at a predetermined distance to the rear of the PRM of that blank, i.e. 200mm in the example specified. However, if the web has under gone shrinkage to the extent that each preprinted web area is 999.5mm in length instead of 1,000mm, then the distance between the PRM and the uncut trailing edge of the web area will be correspondingly reduced by the factor 999.5/1,000 and will be 199.9mm instead of 200mm. Thus, whilst the forme cuts blanks whose length is the same as the reduced length preprinted web areas, there will be a slight offset of 1mm due to this factor. In practice, an offset of this order may and usually will be acceptable and further corrective action will, in general, be unnecessary. However, in a further sophistication of the apparatus, the store 88 is arranged to be updated with the output of store 92 via a scaling circuit 108 for translating the average deviation per cycle into a phase difference value corresponding to the distance between the PRM and the uncut trailing edge of the preprinted web area. Thereafter, the comparator 82 compares the phase difference between the signals supplied via lines 84 and 85 with the updated phase difference stored in store 88 and corrective action is then taken, in the manner described previously, to compensate for the error. Thus, in the example given above, the feed mechanism is temporarily adjusted to produce a blank of 999.4mm length so that the trailing edge of the cut blank is at a distance of 199.9mm to the rear of the PRM, and in the following cycle the feed mechanism is reset to produce blanks of 999.5mm length.

In a modification, the corrective action initiated every nth cycle may be instead initiated only if the mis-registration reaches or exceeds a predetermined limit. For example, if the limit is say 2.0mm and the mis-registration per cycle is say 0.2mm per cycle, then corrective action can be deferred until the sixth cycle in the example described above, i.e. at that stage a correction of 1.4mm is applied for the seventh cycle and thereafter the feed mechanism is adjusted to compensate for the 0.2mm per cycle error.

Although the invention is described above in relation to apparatus similar to that disclosed in our prior patent application Ser. No. 800,317 it will be understood that the invention is also applicable to the apparatus disclosed in our prior U.S. Pat. No. 3,756,149. Also, it is to be understood that the invention is not limited to the circuitry specifically described herein - various modifications being possible within the scope of the appended claims.

In one modification, instead of the circuit being arranged to correct simultaneously for the mis-registration present and for the mis-registration per cycle, i.e. for 1.5mm in the example specifically described, the adjustment may be done in such a way that correction is made for only the mis-registration present prior to cutting the blank then being cut, i.e. for 1.0mm in the example, and the feed mechanism is then reset to 999.5mm, or vice versa.

Having now described my invention what I claim is:

1. Apparatus for treating web material bearing a series of pre-treated areas, said apparatus comprising a pair of rotatably driven treatment rolls including one roll having a treatment area which extends over part of its circumference and is generally co-extensive with one or more of said pretreated areas, said treatment area, when in confronting relation with the other roll of the pair, providing a nip by means of which the web is driven forwardly while it is contacted by the treatment area, an adjustable feed mechanism located adjacent the entering side of the roll pair, said feed mechanism constituting means for decelerating the web upon cessation of contact between the web and said treatment area, moving the web in the reverse direction, and then accelerating it in the forward direction to synchronize the web speed with the linear speed of the treatment area whereby, for a certain adjustment of the feed mechanism setting, the web is advanced forwardly, during the time between cessation of contact and renewed contact with the treatment area, by a standard length increment which, in the absence of any mis-registration between said treament area and the pretreated web area, maintains registration therebetween, characterised by: means for determining the mis-registration, if any, that occurs between said treatment area and said pre-treated web areas over one or more cycles of operation of the apparatus, and means responsive to the misregistration-determining means and operable to temporarily adjust the feed mechanism setting during a following cycle of operation such that the web length advanced by the feed mechanism is varied to compensate for the mis-registration present, the feed mechanism thereafter being restored to its original setting.

2. Apparatus as claimed in claim 1 in which second mis-registration determining means is provided for determining the mis-registration occurring per cycle and in which said adjustment means has a second mode of adjustment in which the feed mechanism setting is adjusted such that the web length advanced is varied to compensate at least for mis-registration shown to be present by said first mis-registration determining means and the feed mechanism is adjusted to a new setting corresponding to a new standard length increment which differs from the previous standard by an amount governed by the mis-registration per cycle as determined by said second means.

3. Apparatus as claimed in claim 2 in which said second mode adjustment is effected so as to correct both for the mis-registration shown to be present by said first means and for the mis-registration per cycle as determined by the second means, the feed mechanism thereafter being adjusted to said new setting.

4. Apparatus as claimed in claim 2 in which is said second mode of adjustment the feed mechanism is first adjusted to compensate only for the mis-registration shown to be present by said first means and is subsequently adjusted to said new setting, or vice versa.

5. Apparatus as claimed in claim 2 in which the first mentioned mis-registration determining means is arranged to detect the phase relation of preselected portions of the pre-treated web areas with respect to a preselected portion of the roll treatment area, the mis-registration being determined by comparing the actual phase relation with a standard phase relation.

6. Apparatus as claimed in claim 10 in which said adjustment means has a third mode of adjustment in which the web length advanced by the feed mechanism is varied to compensate additionally for any non-transient change in the standard phase relation, said first mentioned mis-registration determining means thereafter being arranged to determine web mis-registration by comparison of the actual phase relation with the new standard phase relation.

7. Apparatus as claimed in claim 1 in which said adjustment means is arranged to operate only after mis-registration has been allowed to accumulate over a predetermined number of cycles.

8. Apparatus as claimed in claim 1 in which said adjustment means is arranged to operate only when the mis-registration determined by said mis-registration determining means reaches exceeds a predetermined value.

9. Apparatus as claimed in claim 2 in which each second mode of adjustment is preceded by at least one first mode adjustment.

10. Apparatus as claimed in claim 1 in which the first mentioned mis-registration determining means is arranged to detect the phase relation of preselected portions of the pre-treated web areas with respect to a preselected portion of the roll treatment area, the mis-registration being determined by comparing the actual phase relation with a standard phase relation.

* * * * *

UNITED STATES PATENT OFFICE

CERTIFICATE OF CORRECTION

Patent No. 4,147,078 Dated April 3, 1979

Inventor(s) Thomas D. Bishop

It is certified that error appears in the above-identified patent and that said Letters Patent are hereby corrected as shown below:

Column 6, line 34 "air" should be - -pair- -.

Column 8, line 35 "85" should be - -86- -.

Signed and Sealed this

*Eleventh* Day of *March 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,147,078

DATED : April 3, 1979

INVENTOR(S) : Thomas D. Bishop

It is certified that error appears in the above–identified patent and that said Letters Patent are hereby corrected as shown below:

Column 10, line 21 "10" should be - -5- -.

Signed and Sealed this

*Twenty-eighth* Day of *October 1980*

[SEAL]

*Attest:*

SIDNEY A. DIAMOND

*Attesting Officer*

*Commissioner of Patents and Trademarks*